US005682806A

United States Patent [19]

Kretzschmar

[11] Patent Number: 5,682,806

[45] Date of Patent: Nov. 4, 1997

[54] PRESSURE MEDIUM PLIERS

[76] Inventor: Michael Kretzschmar, Heselstücken 18, D-22453 Hamburg, Germany

[21] Appl. No.: 655,314

[22] Filed: May 24, 1996

[30] Foreign Application Priority Data

May 27, 1995 [DE] Germany ..... 195 19 543.4

[51] Int. Cl.[6] ..... F01B 1/00; F01B 7/00

[52] U.S. Cl. ..... 91/170 R; 91/534; 92/62; 92/63

[58] Field of Search ..... 92/61, 62, 63; 91/170 R, 508, 534, 532

[56] References Cited

U.S. PATENT DOCUMENTS

| | | | |
|---|---|---|---|
| 3,288,036 | 11/1966 | Fisher | 92/62 |
| 3,511,048 | 5/1970 | Nemetz | 92/61 X |
| 3,978,884 | 9/1976 | Sundstrom | 92/63 X |
| 4,024,794 | 5/1977 | Grubb | 92/62 X |
| 5,191,825 | 3/1993 | Beneteau et al. | 92/62 X |

FOREIGN PATENT DOCUMENTS

| | | |
|---|---|---|
| 1465 115 | 10/1964 | German Dem. Rep. . |
| 87 16 694.1 | 12/1987 | Germany . |
| 89 00 250.4 | 1/1989 | Germany . |
| 651 775 A5 | 1/1982 | Switzerland . |

*Primary Examiner*—Hoang Nguyen

*Attorney, Agent, or Firm*—Vidas, Arrett & Steinkraus, P.A.

[57] ABSTRACT

Pressure medium pliers for clamping rings, comprising a pressure medium connection and a pressure medium valve connected thereto, at least one piston controlled by the pressure medium valve, a traverse member drivable by the piston and pivoted pliers members at the inner lever ends of which the traverse member engages for pivoting them, the pressure medium valve having a valve pin which is shiftable in traverse direction of the movement of the piston and operatable by a release trigger, the valve pin blocking the connection of the piston with the pressure medium connection and connecting it with a lower pressure level in a rest position and blocking the connection of the piston with the lower pressure level and connecting it with the pressure medium connection in a working position being reachable by operation of the release trigger, a switching bar which is held in a slideway movable in the direction of the piston and which is mechanically biased by a spring towards the valve pin, the switching bar having a cam and a piston having a stop for engaging the switching bar in the last part of its movement, and the valve pin having a locking seat into which the switching bar snaps under action of the spring at movement of the valve pin from the rest into the working position and which the switching bar releases at its engagement by the piston.

12 Claims, 3 Drawing Sheets

PRESSURE MEDIUM PLIERS

Figure 1:
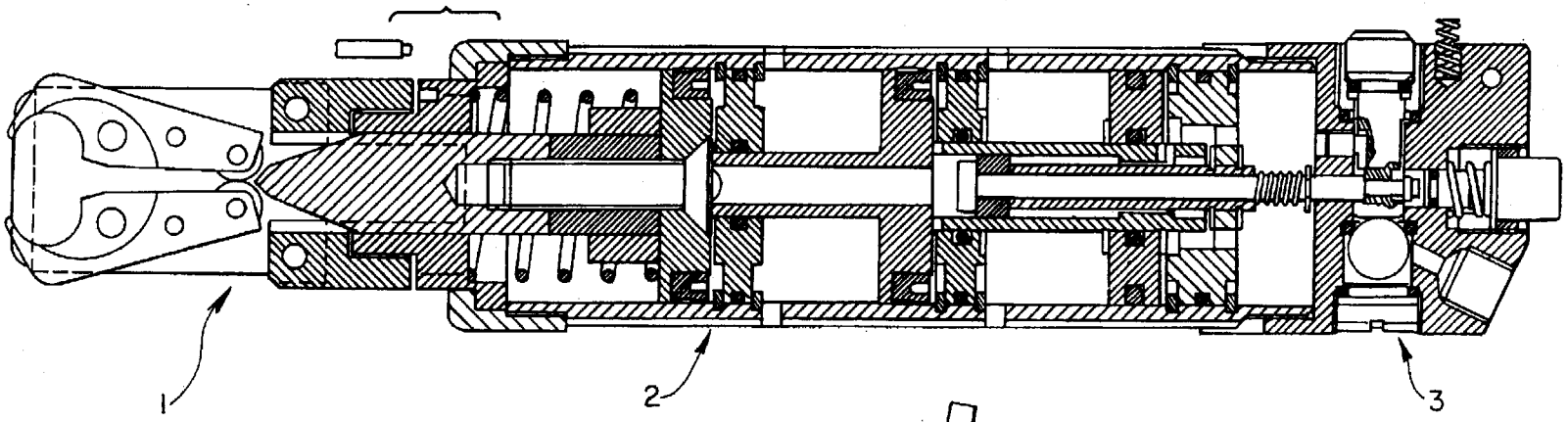

The invention relates to pressure medium pliers for clamping rings and the like according to the preamble of claim 1.

Pressure medium pliers are known from the German Gebrauchsmuster 87 16 694. In these pliers an operation of the pressure medium valve causes the pressurized air to be admitted to the pistons and causes the pistons to pivot the inserted pliers members (pliers halves) by means of the wedge-like traverse member. On discharge of the release trigger the pistons are ventilated so that they are moved back into their starting position by a restoring spring. Thus, on premature release of the release trigger the minimum closing gap is not reached by the pliers members which is necessary for a safe closing of the clamping ring. Even if the pliers are closed to the necessary closing gap, this can be unsufficient if not the full force of the pliers is achieved. To overcome the tilting-up-forces of the material, the closing gap has to be held over a certain period of time. Additionally, in known pressure medium pliers the achievable closing gap is constant so that an adaptation to the respective case of application is only possible by disassembly and mounting of compensation elements of the pliers head.

The CH 651 775 A5 discloses pressure medium pliers of the type mentioned in the beginning, with two pistons and a traverse cone being fixed on a common shaft having an inner step for engaging a collar of a switching bar. In the shaft a pressure spring extending practically over the entire length thereof is mounted which presses the pistons into their starting position towards the valve. Onto the other side of the outer step of the switching bar a pressure spring presses which presses the switching bar towards the valve pin or into a nut formed therein, respectively. These pressure medium pliers are very expensive in assembling due to the mounting of both pistons on one shaft and the arrangement and extension of the springs, and the pliers are limited to two pistons.

Thus, the object of the invention is to provide pressure medium pliers which ensure attainment of the necessary closing gap in the presence of full force and which favour influencing of the closing forces independently of the working pressure. Embodiments of the pressure medium pliers shall enable an easy adaptation of the closing gap to the respective case of application.

The problem is solved by pressure medium pliers having the features of claim 1. Advantageous embodiments of the pressure medium pliers are stated in the subclaims.

The pressure medium pliers according to the invention comprise a forcing control which enforces that after operation of the pressure medium valve pressure medium is admitted to the piston until the necessary closing gap is adjusted and full force is built up and the piston is not pressure-discharged before. For that a switching bar is held in a slideway in the direction of movement of the piston and movable relative thereto, the switching bar being mechanically biased towards the valve pin of the pressure medium valve by a spring between switching bar and an abutment within the housing. The switching bar comprises a cam and the piston is provided with a stop for engaging the switching bar in the last part of its movement for driving the traverse member and closing the pliers members which grasp the clamping ring or the like and which can be insertable and exchangeable. Furthermore, the valve pin comprises a locking seat into which the switching bar snaps under action of the spring at movement of the valve pin from its rest which discharges the piston of the pressure medium into its working position in which pressure medium is admitted to the piston. Thus, on operation of the pressure medium valve the switching bar snaps into the locking seat and first prevents a return of the valve pin into its rest position, even if the release trigger is released. It is not before the switching bar is engaged at its cam by the associated stop of the piston that a return of the valve pin into its rest position is possible. This, however, is only the case in the last part of the movement of the piston. As a result, the piston is always forcibly shifted from its starting position into its end position in which the pliers attain the necessary closing gap over a sufficient period of closing. Then, the release of the release trigger causes the pistons and the pliers members to return into their starting position. Thus, "self controlling" pliers are achieved which ensure the necessary working result and thus a considerable increase in quality. Therefore, especially the requirements of the car industry and newer conceptions of standards are met which consider a shifting of quality assurance to the production devices.

With the pressure medium pliers according to the invention the pressing of the switching bar against the valve pin by means of a spring and the engaging of the switching bar in the end part of the traverse movement is solved much more assembling-friendly as in the state of the art. Furthermore, the invention enables a module-like adaptation of the pressure medium pliers to different force requirements. This is attained, as far as the mechanical biasing of the switching bar is concerned, by supporting of the spring at the intermediate wall between pressure medium valve and pistons. As far as the engaging of the switching bar is concerned, this is achieved in that the adjacent piston is T-shaped and that it has the inner step in its shaft which only struts itself at the following piston. Thus, devices for coupling and engaging the switching bar are limited to the intermediate wall and the adjacent pistons. Further pistons do not receive these construction elements and can independently thereof be manufactured, mounted and can be staggered one after the other in the number necessary for the required closing force. Only the length of the housing is to be adapted to the respective number of pistons. This can be easily done by manufacturing of tubular elements of corresponding lengths which at one end are screwed with the working section and with the other end with the controlling section. Furthermore, intermediate walls can be arranged in the housing for guiding further T-shaped pistons at its shafts.

According to a preferred embodiment, the switching bar already snaps into the locking seat before the valve pin has reached its working position. Thus, an intermediate position between rest and working position is enabled in which the pliers members cannot be pivoted despite operation of the release trigger.

In the particular case, for example in order to avoid accidents, it can be necessary to stop the closing operation of the pliers. Therefore, a release pin can be held in the valve pin, the release pin being shiftable towards the switching bar by operating a pressure release button and pressing the switching bar out of the locking seat. Then, the valve pin can return into its rest position in which the pliers again open.

Preferably, the valve pin has a longitudinally aligned nut into which an alignment pin engages which correctly aligns the valve pin and thus the locking seat and the release pin, respectively.

Preferably, in the housing an intermediate wall is fixed at which the spring is supported and which holds the slideway for the switching bar, respectively. The intermediate wall can also confine the piston movement.

Preferably, several pistons staggered one after the other are provided for pressure transformation which are T-shaped and have a bored shaft as is disclosed in the initially mentioned German Gebrauchsmuster 87 16 694 in detail. In case of a T-shaped piston with a bored shaft being aligned towards the traverse member the switching bar can extend into the bore with its cam formed as outer step, whereby the stop of the piston is formed as inner step in the bore.

For an adjustability of the mimimum closing gap the pliers members can be held at an annular pliers head which is held at the housing of the pressure medium pliers by means of an annular threaded guiding device. Then, an adjusting thread is formed between pliers head and threaded guiding device, the adjusting thread enabling an axial adjusting the pliers head towards the housing. By adjusting the pliers head the position of the pliers members relative to the traverse members is changed, whereby the minimum closing gap is changed. Preferably, an indexing screw is provided between pliers head and threaded guiding device for fixing the parts in different screw adjustments. Moreover, pliers head and threaded guiding device can bear markings for indicating of the different screw adjustments.

The threaded guiding device can have an outer step for angular alignment of the pliers head in relation to the housing and to the release trigger arranged at the housing independently of the adjustment of the adjusting thread, the outer step being overlapped by a flange of a locking ring for fixing at the housing. By releasing the locking ring and turning the threaded guiding device the desired alignment is reached without changing the axial position of the pliers head.

A further adjustment can be realized in that the pressure medium valve is accommodated in a valve housing which is connected to the housing at the opposite end thereof via a further adjusting thread. By adjusting the valve housing it can be influenced in which position of the piston the locking of the valve pin is released and the minimum closing gap is reached. Thus, during the assembly a length compensation for the switching bar is possible. This possibility of adjustment will be used seldom so that preferably the further adjusting thread is provided with a securing ring for clamping of valve housing and housing.

Figure 2:
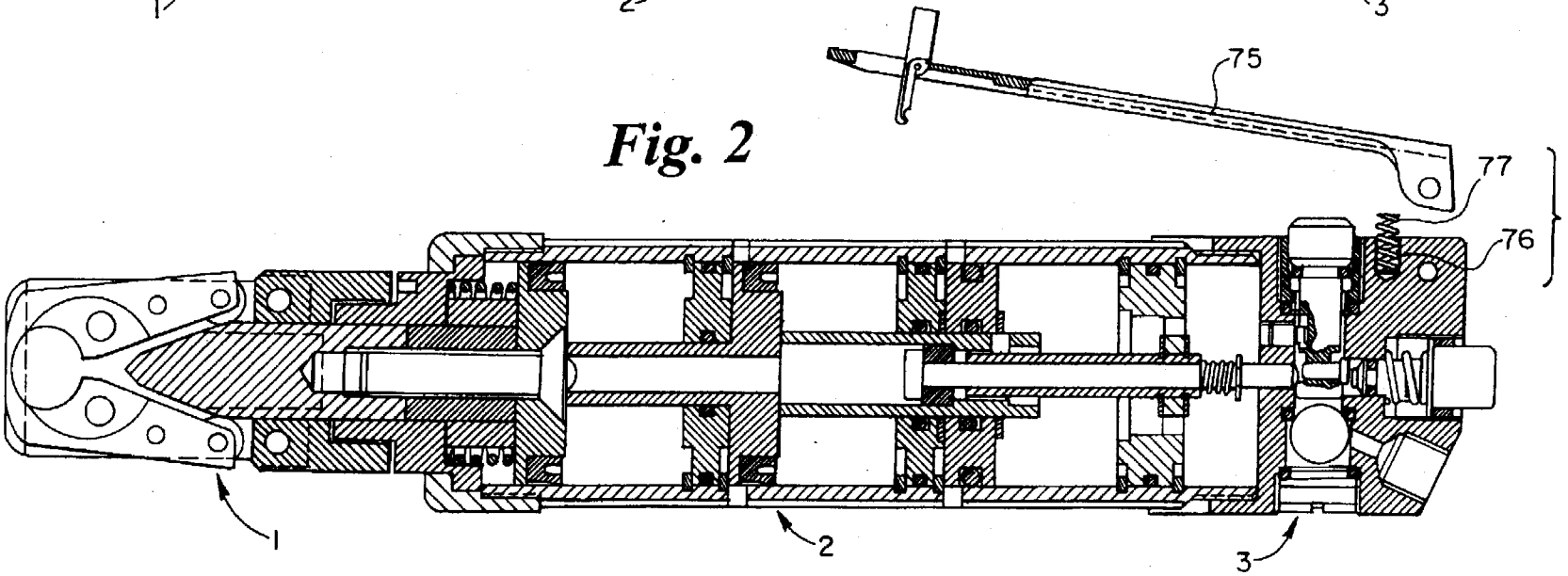
Figure 3:
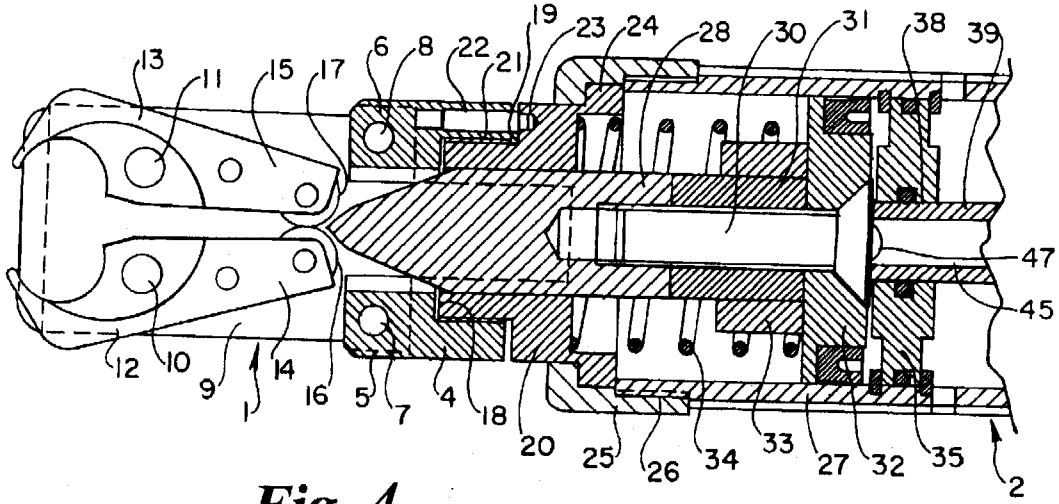
Figure 4:
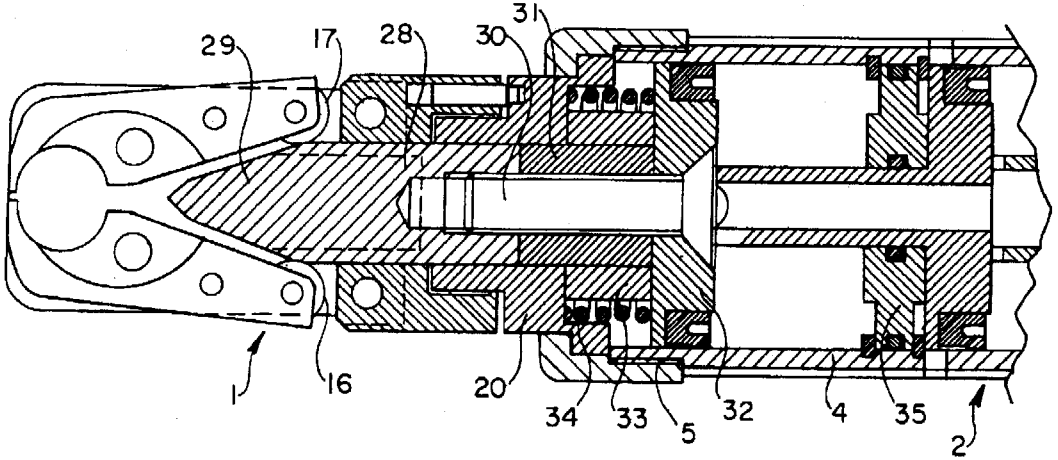
Figure 5:
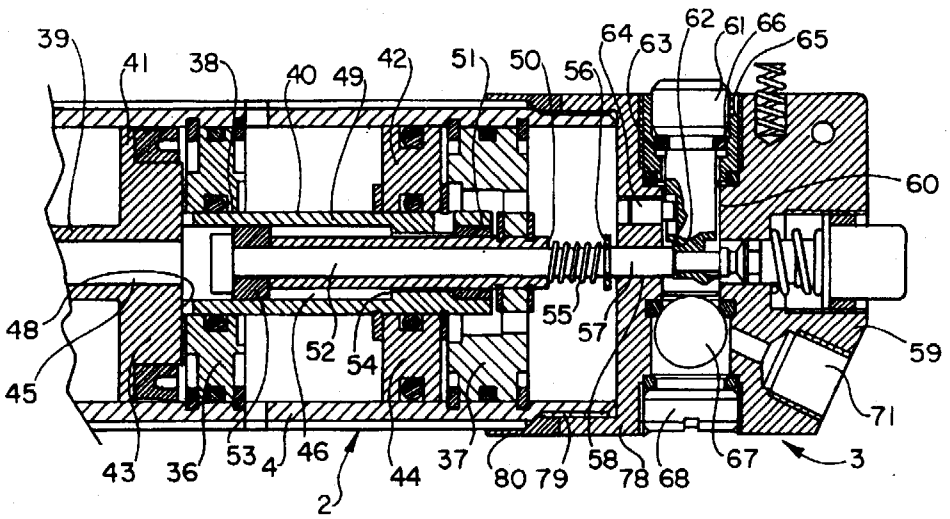
Figure 6:
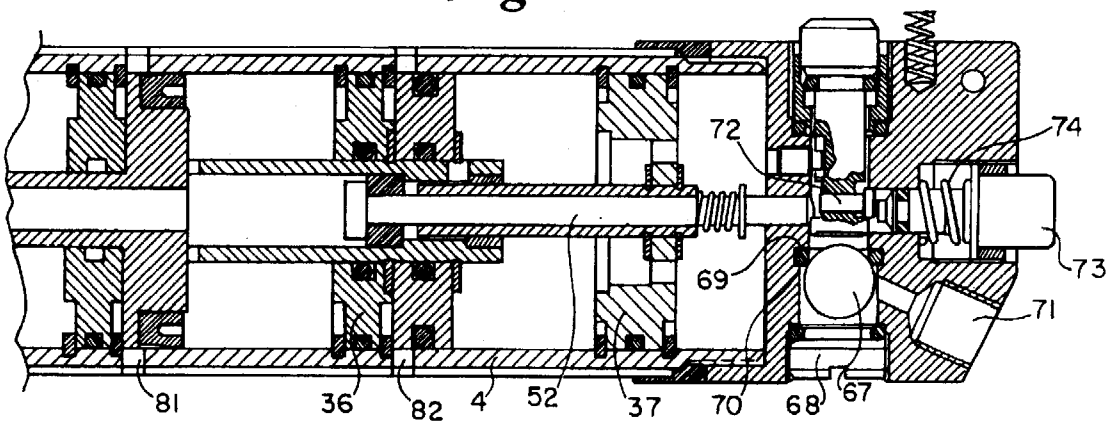

Further details and advantages of the invention will become obvious from the following description of the accompanying drawings of a preferred embodiment. In the drawings show:

FIG. 1 the pressure medium pliers under omission of the release lever on operation with the pistons in the starting position in longitudinal section;

FIG. 2 the pressure medium pliers with blast off release lever after operation of the release trigger with the pistons in the end position in longitudinal section;

FIG. 3 front portion of the pressure medium pliers in the same situation as FIG. 1 in enlarged longitudinal section;

FIG. 4 front portion of the pressure medium pliers in the same situation as FIG. 2 in enlarged longitudinal section;

FIG. 5 back portion of the same pressure medium pliers in the same situation as FIG. 1 in enlarged longitudinal section;

FIG. 6 back portion of the same pressure medium pliers in the same situation as FIG. 2 in enlarged longitudinal section.

As can be seen from FIGS. 1 and 2, the pressure medium pliers consist essentially of three sections: the working section 1, the driving section 2 and the controlling section 3.

As can be better seen from FIGS. 3 and 4, the working section 1 has an essentially annular pliers head 4 which on both sides at ends 5, 6 extending at the front bears side members which are mounted by means of bolts 7, 8 and of which only the back side member 9 is shown in the sectional views.

Both side members arranged parallel to the drawing plane are crossed by insert bolts 10, 11 which swingably pivot insertable pliers members 12, 13, each member constituting a two-armed lever. The pliers members 12, 13 have rolls 16, 17 at their inner lever ends 14, 15. At their outer lever ends the pliers members are pressed apart at maximum so far by a spring—not shown—that the rolls 16, 17 touch each other.

The pliers head 4 has an inner step 18. A front outer step 19 of an essentially annular threaded guiding device is associated with the inner step 18. An adjusting thread 21 is formed between inner step 18 and front outer step 19.

Additionally, a centering pin 22 is located in the separation portion of pliers head 4 and threaded guiding device 20, the centering pin 22 having a threaded seat (it is arranged between the ends 5, 6 and is drawn offset by 90°) and engaging with a centering end into a blind-end bore 23 of which several are distributed around the center axis of the threaded guiding device 20.

The threaded guiding device 20 further comprises a back outer step 24 which is overlapped by the flange of a locking ring 25 directed towards the inside, the locking ring being screwed onto a formed thread 26 of a cylindrical housing 27 of the driving section 2.

The driving section 2 comprises a traverse member 28 which extends from the housing 27 at the front and is directed towards the inner lever ends 14, 15 and the rolls 16, 17, respectively, with a wedge-shaped end 29. The traverse member 28 is fixed at a piston plate 32 by means of a set-screw 30 which crosses a sleeve 31, the piston plate 32 being sealed at the outer periphery towards the housing 27 and being guided therein axially movable.

A further sleeve 33 is located between the threaded guiding device 20 and the piston plate 32, the sleeve 33 forming a stop for the piston plate 32. Additionally, a restoring spring 34 is arranged between threaded guiding device 20 and piston plate 32, the restoring spring 34 mechanically biasing the piston plate 32 from the working section 1. The restoring spring 34 pushes the piston plate 32 back up to a ring-plate-shaped intermediate wall 35 of the housing 27 after pressure discharging.

As can be better seen from FIGS. 5 and 6, the housing 27 is divided by two further essentially ring-plate-shaped intermediate walls 36, 37. All intermediate walls 35, 36, 37 are fixed at the inner wall of the housing 27 and are sealed against it.

In the intermediate walls 35, 36 or in their center openings 38, respectively, shafts 39, 40 of T-shaped pistons 31, 42 are sealingly guided. The piston plates 43, 44 of the pistons 41, 42 are guided sealed at the inner wall of the housing 27. The shafts 39, 40 and piston plates 41, 42 are each provided with a center throughbore 45, 46 so that pressure air let in by the controller 3 simultaneously impinges on the piston plate 32, 43 and 44 and pushes them to the front towards the working section 1. Thereby, the shafts 39, 40 press against the adjacent piston plates 32, 43, whereby a considerable pressure reinforcement takes place. In order that the pressure medium can exit from the seating shaft ends, there are formed diametral outlet openings 47, 48 through which the pressure medium reaches the effective piston end planes.

In the end wall 37 which is adjacent to the controlling section 3 a tubular guide 49 is held. The guide 49 is aligned in direction of movement of the pistons 32, 41, 42, i.e. axially within the housing 27. With one end 50, the guide 49 projects over the intermediate wall 37. On the other side it projects into the throughbore 46 and is supported by a guiding ring 51 within the throughbore 46. The guide 49 leads a switching bar 52 which at both sides projects therefrom. At the end facing the working section 1 outside of the guide 49 the switching bar 52 bears a cam 53 in form of a radially projecting socket. A piston-rigid stop 54 in form of an inner step of the throughbore 46 is associated with the cam 53.

The other end of the switching bar 52 extends into the controlling section 3. It is mechanically biased in this direction by a helical spring 55 which at one end is supported at the end side of the guide and at the other end is supported on the ring 56 mounted on the switching bar 52.

The controlling section 3 receives the associated end 57 of the switching bar 52 in a bore 58 of a valve housing 59, the bore 58 also guiding the end 57 of the switching bar 52. The valve housing 59 comprises a stepped bore 60 which is transversely aligned thereto and in which a valve pin 61 is seated. The valve pin 61 comprises a locking seat 62 in form of an axially aligned nut, the locking seat 62 being able to receive a part of the end 58 of the switching bar 52. The valve pin 61 has a further axially aligned nut 63 into which an alignment pin 64 engages which is fixed relative to the housing. At one end the valve pin 61 is held within a valve socket 65, with an O-sealing ring 66 being arranged between.

The other end of the valve pin 61 is associated with a spherical valve body 67 which is arranged behind a plug 68 which is sealed towards the housing 59. A further O-sealing ring 70 is located between an inner step 69 of the bore 60 and the valve body 67. The portion of the bore 60 comprising the valve body 67 has a pressure medium connection 71.

A small release pin 72 is guided in the valve pin 61, the release pin 72 being directed towards the switching bar 52 and being pressable into the locking seat 62. For this, a pressure release button 73 which projects outside is arranged within the housing 59. The button can be pressed in against the action of a spring 74 and thus, the button presses forward the release pin 72 towards the switching bar 52.

A one-armed release lever 75 (comp. FIG. 2) is supported at the outside of the valve housing 59 and is associated with a projecting end of the valve pin 61. On this side the valve housing 59 has a blind-end bore 76 in which a further helical spring 77 is seated which presses the release lever 75 to the outside.

The valve housing 59 has a cylindrical attachment 78 which is screwed with the associated end of the housing 27. For that, a further adjusting thread 79 is provided. Furthermore, a threaded ring 80 is associated with the further adjusting thread 79 for a clamping safety mechanism.

Finally, the passages 81, 82 of the housing 27 shall be noted which ventilate the piston plates 43, 44 on the side facing the working section 1. The piston plate 32 can be ventilated in this direction sufficiently via the working section 1.

This device works as follows: With unoperated release trigger all pistons 32, 41, 42 are in the starting position, i.e. they are shifted at a maximum towards the controlling section 3 under action of the spring 34. Thereby the switching bar 52 is pressed against the valve pin 61 by the pressure of the spring 55. The valve pin 61 being not charged by the release lever 75 is pressed from the pressure medium connection 71 in the direction of the release trigger by the pressure medium, however, the valve pin 61 is secured in the valve housing 59 by the alignment pin 64 and release pin 72, respectively. In this position the switching bar 52 does not snap into the locking seat 62. The pliers members 12, 13 are pivoted apart at a maximum.

Upon operation of the release lever 75,at first the switching bar 52 snaps into the locking seat 62 of the valve pin 61 due to the tension of the spring 55 (FIGS. 1, 3 and 5). Then, the valve body 67 is pressed out of the seat in the O-sealing ring 69 by the valve pin 61. Pressure medium from the pressure medium connection 71 flows through gaps between bore 60 and valve pin 61 and a—not shown—bore of the valve housing 59 into the housing 27 and spreads through an axial passage of the intermediate wall 37 and the throughbores 46, 45, respectively, so that all pistons 32, 41, 42 are pressed towards the working section 1.

Aproximately 1.5 mm before the pistons reach their end position in which the minimum closing gap is adjusted between the pliers members 12, 13 by the action of the traverse member 28, the pulling out of the switching bar 52 out of the locking seat 62 of the valve pin 61 begins due to contact of the cam 53 at the stop 54.

In the end position of the pistons 32, 41, 42 the valve pin 61 is completely free, i.e. when the adjusted closing gap between the pliers members 12, 13 is reached, the pistons can be ventilated by releasing the release lever 75 (FIGS. 2, 4 and 6). Then, the pressure air drives back the valve pin 61 into the rest position in which the housing 27 is ventilated towards the surrounding atmosphere via the—not shown—bore of the valve housing 59 and gaps between valve pin 61 and bore 60 as well as socket 65. Then, the pistons are again moved towards the controlling section 3 by the pressure of the spring 34 and the starting situation is reached again.

If after an operation of the release lever 75 the end position of the pistons or the minimum closing gap of the pliers members 12, 13, respectively, are not yet reached upon releasing the valve lever 75 the switching bar 52 prevents a ventilation of the pistons by locking the valve pin 61. For then the switching bar has not yet snapped in the locking seat 62 of the valve pin 61.

A manual ventilation, however, is always possible by operation of the ventilation button 73.

Thereby the switching bar 52 is pressed out of the locking seat 62 of the valve pin 61 by means of the released pin 72. The ventilation of the pistons takes place as described before.

A change of the minimum closing gap of the pliers members 12, 13 is possible through an axial displacement of the pliers head 4 towards the traverse member 28. By turning the pliers head 4 on the threaded guiding device 20, the axial displacement towards the wedge 28 is attained. Subsequently, the pliers head 4 is again indexed by means of the indexing screw 22. Thereby, the turning through an "indexing point" can correspond for example to a change of the closing gap of 0.1 mm.

A "fine adjustment" of the release point of the ventilation is carried out by turning the valve housing 59. Before, its clamping has to be disengaged by means of the threaded ring 80 at the housing 4. After the fine adjustment the valve housing 59 is secured against the valve housing 59 by putting under stress the threaded ring 80.

If the pressure medium pliers shall be constructed stronger, further pistons and intermediate walls can be arranged between the pistons 41 and 32 under corresponding elongation of the tubular housing 27, the further pistons and intermediate walls being formed like the piston 41 and the intermediate wall 35. The pliers can also be adapted module-like to the respective requirements.

We claim:

1. Pressure medium pliers for clamping rings, comprising a pressure medium connection (71) and a pressure medium valve (60, 61, 66, 67, 69) connected thereto, several pistons (32, 41, 42) controlled by the pressure medium valve, a traverse member (28) drivable by the pistons, pivoted pliers members (12, 13) at the inner lever ends (14, 15) of which the traverse member engages for pivoting them, the pressure medium valve (60, 61, 66, 67, 69) having a valve pin (61) which is driven shiftably in the traverse direction of the piston movement and operatable by a release trigger (75), the valve pin blocking the connection of the pistons (32, 41, 42) with the pressure-medium connection and connecting those with a lower pressure level in a rest position and blocking the connection of the pistons with the lower pressure level and connecting those (32, 41, 42) with the pressure medium connection in a working position being reachable by operation of the release trigger (75), a switching bar (52) which is held in a slideway (49) movable in the direction of the pistons (32, 43, 44) and which is mechanically biased by a spring (55) towards the valve pin (61), the switching bar (52) having an outer step as cam (53) and the pistons having a bored shaft which receives the switching bar (52) and has an inner step as stop (54) corresponding to the outer step (53) for engaging the switching bar in the last part of its movement for closing the pliers members (12, 13), and the valve pin (61) having a locking seat (62) into which the switching bar (52) snaps under action of the spring (55) at movement of the valve pin (61) from the rest into the working position and which the switching bar (52) releases at its engaging by the piston (42), characterized in that an intermediate wall (37) is fixedly mounted at an inner wall of the housing between pressure medium valve (60, 61, 66, 67, 69) and pistons (32, 41, 42), with the spring supported at the intermediate wall (37), and that the piston (42) arranged adjacent to the intermediate wall (37) is T-shaped and supports its shaft (40) which is directed to the traverse member and provided the inner step at the following piston (41).

2. Pressure medium pliers according to claim 1, characterized in that the switching bar (52) snaps into the locking seat (62) before the valve pin (61) reaches its working position.

3. Pressure medium pliers according to claim 1, characterized in that in the valve pin (61) a release pin (72) is held which is shiftable towards the switching bar (52) by operating a pressure release button in order to press the switching bar (52) out of the locking seat (62).

4. Pressure medium pliers according to claim 1, characterized in that the valve pin (61) has a longitudinally aligned nut (63) into which an alignment pin (64) engages.

5. Pressure medium pliers according to claim 1, characterized in that the intermediate wall (37) between pressure medium valve (60, 61, 66, 67, 69) and pistons (32, 41, 42) holds the slideway (49) for the switching bar.

6. Pressure medium pliers according to claim 1, characterized in that the pliers members (12, 13) are held at an annular pliers head (4), that the pliers head (4) is held at the housing (27) by means of an annular threaded guiding device (20) and that between the pliers head (4) and the threaded guiding device (20) an adjusting thread (21) is formed for axial adjustment of the pliers head (4) relative to the traverse member (28).

7. Pressure medium pliers according to claim 6, characterized in that the threaded guiding device has an outer step (24) which is overlapped by a flange of a locking ring (25) for fixing the threaded guiding device (20) at the housing (27).

8. Pressure medium pliers according to claim 6, characterized in that between pliers head (4) and threaded guiding device (20) an indexing screw (22) is arranged for fixing of pliers head (4) and threaded guiding device (20) in different screw adjustments.

9. Pressure medium pliers according to claim 6, characterized in that pliers head (4) and threaded guiding device (20) bear markings for indicating of the screw adjustments thereof.

10. Pressure medium pliers according to claim 1, characterized in that the pressure medium valve (60, 61, 66, 67, 69) is accommodated in a valve housing (59) and that at the end of the housing (27) opposite the pliers members (12, 13) the valve housing (59) is screwed with the housing (27) via a further adjusting thread (79).

11. Pressure medium pliers according to claim 10, characterized in that the further adjusting thread (79) bears a threaded ring (80) for securing the thread connection between valve housing (59) and housing (27) in different screw adjustments.

12. Pressure medium pliers according to claim 1, characterized in that it has several pistons (41, 42) staggered one after the other, being T-shaped and having a bored shaft (39, 40).

* * * * *